US006445139B1

(12) United States Patent
Marshall et al.

(10) Patent No.: US 6,445,139 B1
(45) Date of Patent: Sep. 3, 2002

(54) LED LUMINAIRE WITH ELECTRICALLY ADJUSTED COLOR BALANCE

(75) Inventors: Thomas M. Marshall, Hartsdale; Michael D. Pashley, Cortlandt Manor, both of NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/663,050

(22) Filed: Sep. 15, 2000

Related U.S. Application Data

(63) Continuation-in-part of application No. 09/216,262, filed on Dec. 18, 1998, now Pat. No. 6,127,783.

(51) Int. Cl.[7] ..... G05F 1/00

(52) U.S. Cl. ..... 315/291; 315/149; 315/307; 315/360; 250/226

(58) Field of Search ..... 315/291, 133, 315/131, 307, 360, 149, 152, 154, 158; 250/552, 553, 226; 362/800

(56) References Cited

U.S. PATENT DOCUMENTS

| | | | | | |
|---|---|---|---|---|---|
| 3,760,174 | A | | 9/1973 | Boenning et al. | 315/312 X |
| 4,720,190 | A | * | 1/1988 | Peterson | 356/45 |
| 4,810,937 | A | | 3/1989 | Havel | 315/152 |
| 4,847,490 | A | * | 7/1989 | Nishikama | 250/227 |
| 5,268,828 | A | | 12/1993 | Miura | 362/249 |
| 5,301,090 | A | | 4/1994 | Hed | 362/32 |
| 5,471,052 | A | | 11/1995 | Ryczek | 250/226 |
| 6,095,661 | A | * | 8/2000 | Lebens et al. | 362/800 |
| 6,122,042 | A | * | 9/2000 | Wunderman et al. | 356/73 |

FOREIGN PATENT DOCUMENTS

| | | | | |
|---|---|---|---|---|
| EP | 505878 A | * | 3/1992 | G01J/3/50 |
| WO | WO 0037904 A | * | 6/2000 | G01J/3/50 |

OTHER PUBLICATIONS

"LED Luminaire with Electronically Adjusted Color Balanlce", U.S. Ser. No. 09/216,262, filed Dec. 18, 1998.

Patent Abstract of Japan: Public. No.: 10281873, Publ Date: Oct. 23, 1997; Applic No.: 09083483.

Patent Abstract of Japan:: Public. No. 60216336, Public. Date.: Oct. 29, 1985; Appl. No. 59071886.

* cited by examiner

*Primary Examiner*—Don Wong
*Assistant Examiner*—Thuy Vinh Tran

(57) ABSTRACT

A luminaire comprises an array of LEDs that include at least one LED in each of a plurality of colors. Supplied to the LEDs for each color is an electrical current that, during a measuring period, comprises a measuring drive pulse having at least a first boost portion and a turn-off portion. The LEDs relating to each color have a light output which has a nominal continuous value during ordinary operation and increases during the boost portion and is interrupted during the turn-off portion. The array has a combined light output when current is supplied to all of the LEDs in the array. A photodiode is arranged to measure the combined light output which selectively turning off the electrical current to the LEDs so that the photodiode measures the light output for each color separately in response to the measuring drive pulse. The average light output during the measuring period is substantially equal to the nominal continuous light output during the ordinary operation so as to avoid visible flickers.

14 Claims, 4 Drawing Sheets

LED LUMINAIRE WITH ELECTRICALLY ADJUSTED COLOR BALANCE

RELATED REFERENCES

This application is a continuation-in-part of a previously filed patent application having Ser. No. 09/216,262 filed Dec. 18, 1998, now U.S. Pat. No. 6,127,783, and incorporated herein by reference.

BACKGROUND OF THE INVENTION

The invention relates to a luminaire with an array of red, green and blue light emitting diodes (LEDS), and more particularly to a white light emitting luminaire with a control system for adjusting the individual components to maintain a desired color balance (chromaticity).

U.S. Pat. No. 5,301,090 discloses an LED luminaire having an array of LEDs including a plurality of LEDs in each of the colors red, green and blue. The LEDs for each color are wired in parallel and provided with a separate power supply, and a diffusion screen is provided over the array. The chromaticity of the assembly is manually controlled by three knobs for the respective colors; automatic control is not mentioned.

LEDs are semiconductor based; for a given drive current, light output varies from chip to chip, and also varies over the life of each chip. Light output also varies inversely with temperature, but not uniformly for each color. Finally, in a block of LEDs of a given color, the light output will vary if one or more of the LEDs fails. Given all the factors which can affect the color balance of any array of LEDs it would be desirable to automatically monitor and regulate the color balance, especially in a white-light emitting luminaire.

It is known to control current to an array of LEDs in a given color based temperature, for example in a traffic light. This scheme would be cumbersome in a luminaire having LEDs in a plurality of colors, because the temperature (and therefore the light intensity) does not vary uniformly for the various colors.

It would be desirable to automatically control the chromaticity of a white light emitting luminaire, without regard to the factors which cause the light outputs of the individual colors to vary.

It would further be desirable to automatically control the chromaticity without resorting to a spectrally resolving light measuring system such as a photodiode and filter for each of the respective colors.

SUMMARY OF THE INVENTION

According to the invention, the combined light output (chromaticity) of a white light emitting LED luminaire is electronically controlled based on measurements by a single photodiode arranged to measure the light outputs of all the LEDs in the array. This is accomplished by measuring the light output of the LEDs in each color separately in a sequence of time pulses. For an array of red, green, and blue LEDs there are three time pulses in a measuring sequence. During each time pulse, the current for the colors not being measured is turned off. The response time of a typical photodiode is extremely short, so the measuring sequence can be performed in a sufficiently short time that an observer will not detect it (e.g. 10 ms).

Measured light outputs for the colors are compared to desired outputs, which may be set by user controls, and changes to the power supply for the color blocks are made as necessary. Chromaticity is thus automatically controlled without regard to the factors which may cause it to change. The user inputs permit varying the desired chromaticity to either warm white (more red output) or cool white (more blue output).

In order to best compensate for temperature dependant changes during a warm-up phase, the electronic control circuitry may undertake the measuring sequence more frequently during warm-up. Less frequent measurements are sufficient to compensate for long term changes in the LEDs after a stable operating temperature is reached.

Where the LEDs in each color are wired in parallel, the failure of an LED can be automatically compensated by varying the current to the remaining LED during the next measuring sequence.

In accordance with another embodiment of the invention, the array of LEDs is driven by a current supply source, that includes a measuring drive pulse having at least a first boost portion and a turn-off portion. The LEDs in each color have a light output that has a nominal continuous value during ordinary operation and increases during the boost portion and is interrupted during the turn-off portion. The array of LEDs have a combined light output when current is supplied by the current supply source. A photodiode is arranged to measure the light outputs of all LEDs in the array. The electrical current is selectively turned-off to the LEDs so that the photodiode measures the light output for each of the colors separately in response to the measuring drive pulse.

These and additional advantages of the invention will be apparent from the drawing figures and description which follows.

DESCRIPTION OF THE PREFERRED EMBODIMENTS

Figure 1:
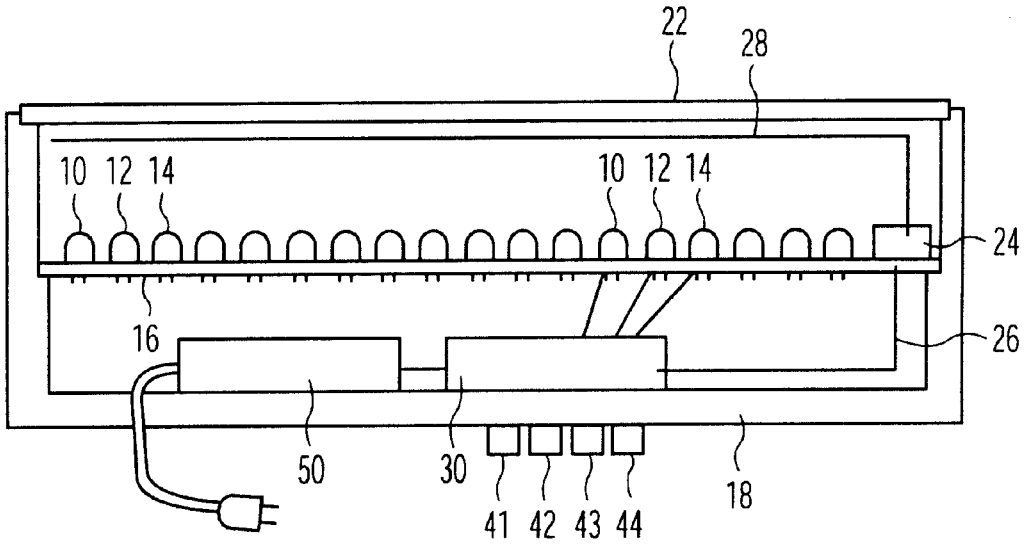
FIG. 1 is a cross-sectional view of a luminaire according to the invention, with an optical fiber light pick-up.

Referring to FIG. 1, an LED luminaire according to the invention includes a two dimensional array of LEDs 10, 12, 14 including a plurality of LEDs in each of a plurality of colors. In the present case the array includes red LEDs 10, green LEDs 12, and blue LEDs 14 mounted on a wired substrate 16 in a housing 18. The LEDs are arranged so that the overall light output will be white; a diffuser 22 mounted on the housing 18 is provided to enhance mixing. LEDs in additional colors, such as amber may be used to enhance the mixing options. The mixing optics may include means other than a diffuser.

A single photodiode 24 is arranged to sense the light intensity of all the LEDs in the array. In FIG. 1 an optical fiber 28 extending along the length of the housing 18 sends light to the photodiode 24, which generates corresponding current signals for controller 30 via a feedback line 26. For small arrays the photodiode senses for each array, without the optical fiber arrangements depicted in FIG. 1.

Figure 2:
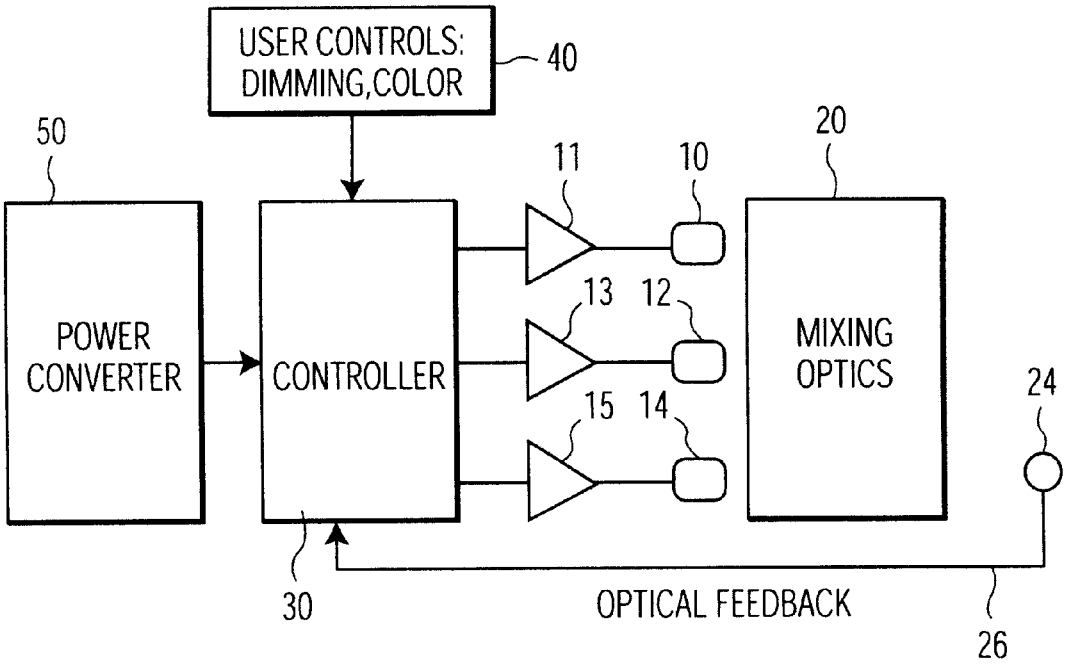
FIG. 2 is a schematic diagram of the luminaire.

Referring also to FIG. 2, a controller 30 translates the feedback from the photodiode 24 into color point measurements which are compared with desired settings provided via user controls 40. Based on the comparison, controller 30 decides whether the desired color balance is present, and accordingly signals current regulators 11,13,15 for the respective diodes 10, 12, 14. A power input from an AC converter 50 is thus translated into current outputs which control the light intensity for the respective colors red, green, and blue to obtain the desired color balance. The diodes for each color of the array are kept at a common potential by wiring on the substrate 16. User controls for the designed setting include inputs 41, 42, 43 for the respective colors, and dimmer 44 which controls overall intensity of the resulting white light.

Figure 3:
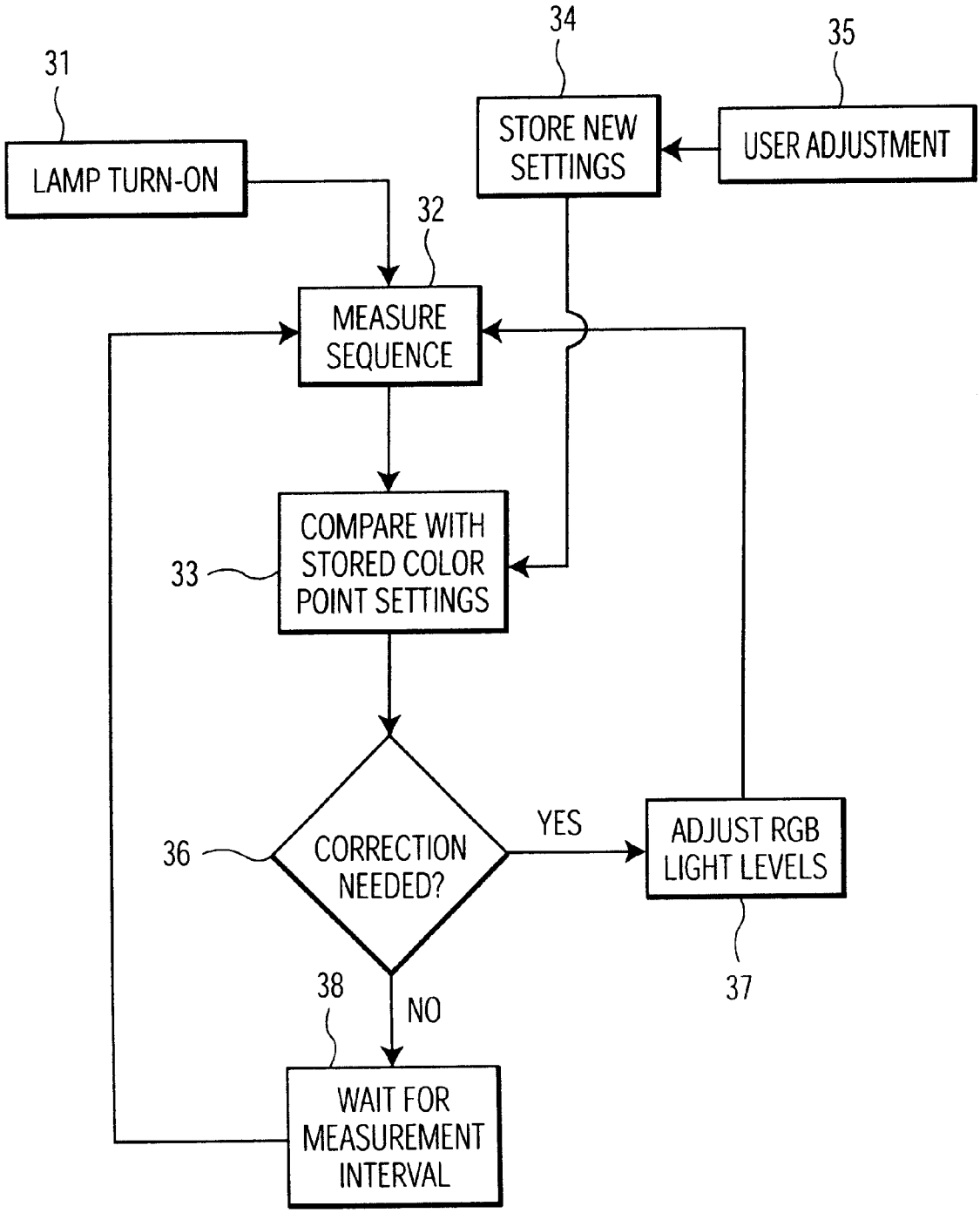
FIG. 3 is a diagram of a control logic sequence.

FIG. 3 depicts the control logic sequence for the luminaire in a diagram. When the lamp is turned on (31), power is provided to the LEDs and a measuring sequence is initiated (32). Color point measurements are compared (33) with desired setting which are stored (34) pursuant to user adjustment (35). Based on this comparison, it is determined (36) whether color adjustments are necessary, and if so, adjustments are made (37) and the measuring sequence is repeated (32). If it is determined that color adjustments are not necessary (36), the controller will wait for a predetermined measuring interval (38) before repeating the measuring sequence (32).

Figure 4:
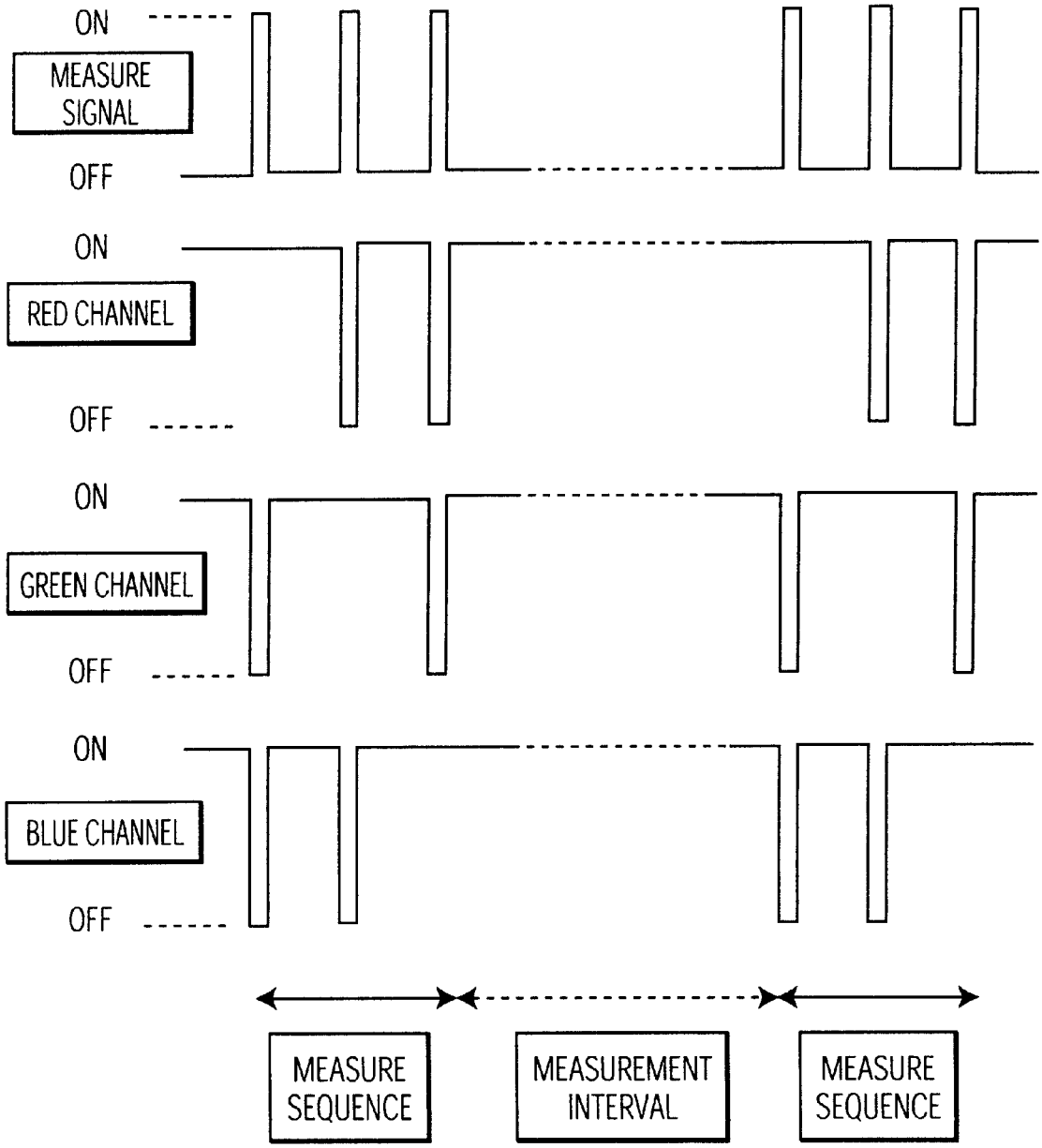
FIG. 4 is a timing diagram for an optical feedback system.

FIG. 4 is a timing diagram illustrating the control logic sequence, which is executed while the luminaire is turned on. The topmost of the four traces is a measuring signal consisting of a series of three pulses (the measuring sequence), separated by a span of time (the measuring interval). During the first pulse, the green and blue LEDs are turned off so that the photodiode can measure the light intensity of red LEDs; during the second pulse the red and blue LEDs are turned off so that the photodiode can measure the light intensity of the green LEDs; during the third pulse the red and green LEDs are turned off so that the photodiode can measure the light intensity of blue LEDs. The control electronics then compares the measured intensities with the desired intensities and adjusts the current to one or more groups of LEDs as may be necessary.

The response time of a typical photodiode is extremely short, and each pulse can be so short than an observer will not detect it, e.g. 1.0 ms. Thus a measuring sequence can be performed during the normal operation of the luminaire. The length of the measurement interval depends on how quickly the light output varies. This depends, for example, on how quickly the temperature of the LED's is changing. It could range from every minute or less to every few hours; the control logic can be programmed for frequent measurements shortly after start-up, followed by less frequently measurements when stable operating temperature is reached.

It is possible for the luminare to include more than one string of LEDs in each color, and to measure the outputs of the strings individually. For example, with two strings in each of three colors, a measuring sequence would have six pulses. In every case it is preferable to adjust the color balance based on all of the measurements in a sequence, rather than adjusting the individual colors based solely on the corresponding light output.

The foregoing is exemplary and not intended to limit the scope of the claims which follow.

Although the drive pulses in each of the channels mentioned above in reference with FIG. 4 is substantially short, for example, in the order of 1–2 ms, many observers may still notice flickers in the emitted light. This follows because the human eye responds to light by integrating the light received in the eyes over intervals of about 15 msec. Therefore, a sensitive eye can observe light interruptions for a period, as short as 400 $\mu$s. It is thus desirable to shorten each "turn off" period in a measuring sequence to 400 $\mu$s or less. However, this duration may be extremely short for conventional electronic circuits to measure the light intensity of the LEDs.

Figure 5:
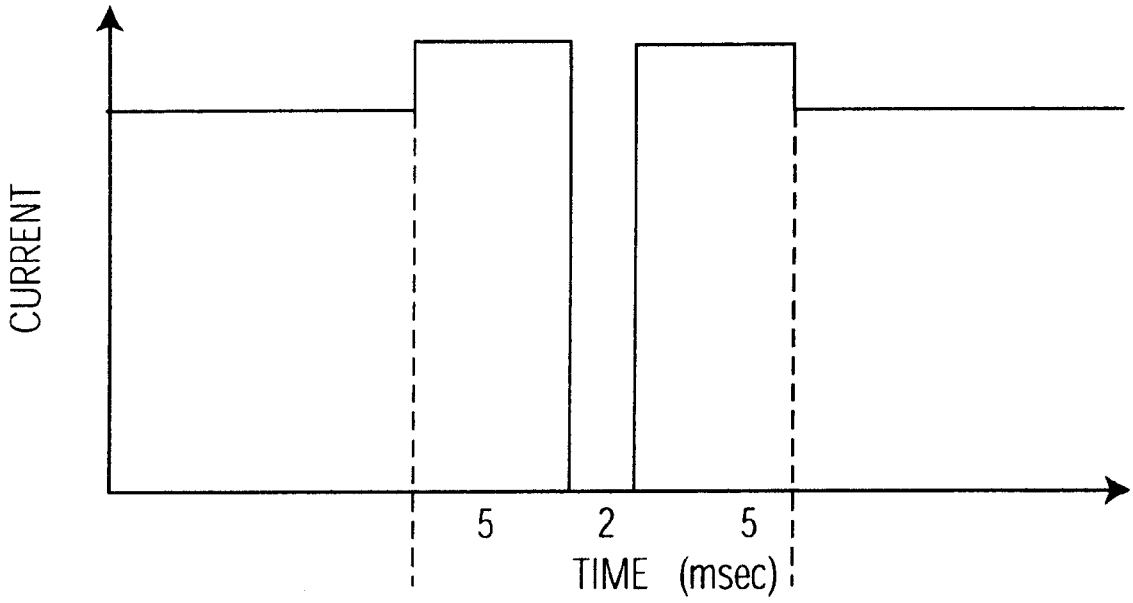
FIG. 5 illustrates a measuring drive sequence.

In accordance with another embodiment of the invention, the drive pulse of each channel during each measurement sequence is varied to accommodate for such possible flickers. FIG. 5 illustrates an exemplary measuring drive pulse during a measurement sequence in accordance with one embodiment of the invention. Accordingly the measuring drive pulse includes a first boost portion followed by a turn-off or interruption period, which in turn is followed by a second boost portion. There are, among other things, three constraints that influence the choice of each measuring drive pulse. First, the boost portion of each pulse is preferably as low as possible to avoid any long term damage on the LEDs. Second, the turn-off or interruption period is preferably as long as possible to facilitate accurate measurements with less expensive components. Third, the entire sequence of the first boost portion, turn-off period and second boost portion is preferable around 15 msec, in order to avoid visible artifacts.

In accordance with one embodiment of the invention, a measuring drive pulse that provides a stable appearance of light level in the LEDs, includes a 5 msec boost to 120% of the nominal light output, followed by a 2 msec complete interruption of current, followed by another 5 msec boost of 120% of the nominal light output.

In accordance with another embodiment of the invention, the drive pulse sequence is symmetric, such that the two boost portions in the sequence exhibit the same amplitude and duration, although the invention is not limited in scope in that respect. For example, in accordance with yet another embodiment of the invention, the measuring drive pulse includes two components comprising a first boost portion followed by a turn-off period. Furthermore, other shapes of measuring drive pulse having at least one boost portion and one turn-off portion may be employed in accordance with the principles of the present invention. Preferably, the pulses are chosen such that, within the integration time of the human eye Bi.e. about 15 msec. B the average light level of the driven LED is the same as the nominal continuous value during ordinary operation.

In accordance with one embodiment of the invention, the light output is approximately proportional to the drive current, such that a specific percentage of increase in the drive current corresponds to a proportional increase in the light output level. Thus, for example, if it is desired to increase the light output level to 120% as illustrated in FIG. 5, the increase in current is a predetermined percentage, for example 120% also. Thus, it is possible to employ a measuring drive pulse sequence that includes a specific current boost percentage for all drive levels.

However, LEDs do not necessarily exhibit a proportional relationship between the light output level variations and drive current variations at all operating currents. Thus, in accordance with another embodiment of the invention, in order to achieve a better accuracy in maintaining a constant light output level during measurement sequences, the light vs. current relationship is calibrated for the luminaire, and the boost current values are chosen such that the light level averages to the nominal dc level, at all levels of operation. In order to store the calibrated current vs. light output relationship, controller 30 is configured to include a database that provides the amount of current variation necessary for any desired change in light output level for a range of operating conditions.

We claim:

1. A luminaire comprising:

an array of LEDs comprising at least one LED in each of a plurality of colors;

means for supplying electrical current to said LEDs in each said color, said electrical current having a measuring period that comprises a measuring drive pulse having at least a first boost portion and a turn-off portion, said LEDs in each said color having a light output, such that said light output has a nominal continuous value during ordinary operation and increases during said boost portion and is interrupted during said turn-off portion, and the array having a combined light output when current is supplied to all of the LEDs in the array;

a photodiode arranged to measure the light outputs of all the LEDs in the array; and means for selectively turning off the electrical current to said LEDs so that said photodiode measures the light output for each color separately in response to said measuring drive pulse.

2. The luminaire in accordance with claim 1 wherein the average light output during the measuring period is substantially equal to the nominal continuous light output during said ordinary operation so as to avoid visible flickers.

3. The luminaire in accordance with claim 2 wherein said measuring drive pulse further comprises a second boost portion following said turn-off portion.

4. The luminaire in accordance with claim 3, wherein said first and second boost portions have the same duration and amplitude.

5. The luminaire in accordance with claim 4, wherein said first and second boost portions are 120% of said nominal continuous light value.

6. The luminaire in accordance with claim 5, wherein the duration of said first and second boost portion is approximately 5 msec and duration of said turn-off portion is approximately 2 msec.

7. The luminaire in accordance with claim 2 further comprising means for storing calibrated values associating LED drive current variations with LED light output variations.

8. A method for driving an array of LEDs comprising at least one LED in each of a plurality of colors in a luminaire comprising the steps of:

supplying electrical current to said LEDs in each said color, such that said LEDs have a light output with a nominal continuous value during ordinary operation;

boosting said electrical current during a measuring period so as to define a measuring drive pulse having at least a first boost portion;

turning-off said electrical current during said measuring period so as to define a turn-off portion, such that said light output increases during said boost portion and is interrupted during said turn-off portion, and the array having a combined light output when current is supplied to all of the LEDs in the array;

measuring the light outputs of all the LEDs in the array; and selectively turning off the electrical current to said LEDs so as to measure the light output for each color separately in response to said measuring drive pulse.

9. The method in accordance with claim 8 further comprising the step of maintaining the average light output during the measuring period substantially equal to the nominal continuous light output during said ordinary operation so as to avoid visible flickers.

10. The method in accordance with claim 9 further comprising the step of boosting said electrical current so as to define a second boost portion following said turn-off portion.

11. The method in accordance with claim 10 further comprising the step of maintaining said first and second boost portions to have the same duration and amplitude.

12. The method in accordance with claim 11 further comprising the step of boosting said electrical current signal by 120% of said nominal continuous light value.

13. The method in accordance with claim 12 further comprising the step of maintaining the duration of said first and second boost portion to about 5 msec and maintaining the duration of said turn-off portion to about 2 msec.

14. The method in accordance with claim 9 further comprising the step of storing calibrated values associating LED drive current variations with LED light output variations.

* * * * *